US010405727B2

(12) United States Patent
Boyer

(10) Patent No.: US 10,405,727 B2
(45) Date of Patent: Sep. 10, 2019

(54) DISK DIVERTER ASSEMBLY FOR A DISHWASHER APPLIANCE

(71) Applicant: Haier US Appliance Solutions, Inc., Wilmington, DE (US)

(72) Inventor: Joel Charles Boyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 228 days.

(21) Appl. No.: 15/627,510

(22) Filed: Jun. 20, 2017

(65) Prior Publication Data

US 2018/0360293 A1 Dec. 20, 2018

(51) Int. Cl.

| | |
|---|---|
| ***A47L 15/42*** | (2006.01) |
| ***A47L 15/23*** | (2006.01) |
| ***A47L 15/46*** | (2006.01) |
| ***A47L 15/50*** | (2006.01) |

(52) U.S. Cl.

CPC ..... *A47L 15/4221* (2013.01); *A47L 15/23* (2013.01); *A47L 15/4225* (2013.01); *A47L 15/4259* (2013.01); *A47L 15/4274* (2013.01); *A47L 15/4293* (2013.01); *A47L 15/46* (2013.01); *A47L 15/502* (2013.01); *A47L 15/507* (2013.01)

(58) Field of Classification Search

CPC ..... A47L 15/4221

See application file for complete search history.

(56) References Cited

U.S. PATENT DOCUMENTS

| | | | | |
|---|---|---|---|---|
| 8,900,375 | B2 | 12/2014 | Gnadinger et al. | |
| 9,119,517 | B2 | 9/2015 | Carlson et al. | |
| 9,228,663 | B2 | 1/2016 | Brignone et al. | |
| 2010/0139698 | A1 | 6/2010 | Gnadinger et al. | |
| 2015/0122298 | A1* | 5/2015 | Boyer | A47L 15/4221 134/179 |
| 2016/0360945 | A1 | 12/2016 | Boyer et al. | |

* cited by examiner

*Primary Examiner* — Jason Y Ko

(74) *Attorney, Agent, or Firm* — Dority & Manning, P.A.

(57) ABSTRACT

A dishwasher appliance is provided having a disk diverter assembly operably coupled to a primary supply conduit for selectively diverting a flow of wash fluid between a middle spray assembly and an upper spray assembly. The disk diverter assembly includes a diverter disk positioned within a diverter housing defining a fluid inlet, a first fluid outlet in fluid communication with the middle spray assembly, and a second fluid outlet in fluid communication with the upper spray assembly. The diverter disk defines an aperture and a partial flange that extends along an axial direction. A positioning assembly selectively rotates the diverter disk between a first position where wash fluid is directed only through the first fluid outlet to the middle spray assembly and a second position where wash fluid is directed only through the second fluid outlet to the upper spray assembly.

20 Claims, 6 Drawing Sheets

DISK DIVERTER ASSEMBLY FOR A DISHWASHER APPLIANCE

FIELD OF THE INVENTION

The present disclosure relates generally to dishwasher appliances, and more particularly to improved fluid distribution systems for dishwasher appliances.

BACKGROUND OF THE INVENTION

Dishwasher appliances generally include a tub that defines a wash chamber. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including e.g., a lower spray arm assembly mounted to the tub at a bottom of the wash chamber, a mid-level spray arm assembly mounted to one of the rack assemblies, an upper spray assembly mounted to the tub at a top of the wash chamber, and/or other spray arms, assemblies, manifolds, or devices.

Conventional dishwasher appliances are typically equipped with at least one pump for circulating fluid through the multiple spray assemblies. In addition, devices referred to as diverters may be used to control the flow of fluid received from the pump. For example, a primary diverter may be positioned within a sump of the dishwasher appliance for selectively controlling the flow of wash fluid between four supply conduits. However, certain dishwasher appliances include more spray assemblies than can be supported by the primary diverter alone. More specifically, space restrictions within the sump portion of the dishwasher often limit the number of spray assemblies that may be supported by the operation of the primary diverter. Thus, additional pumps, fluid supply conduits, and or complicated diverter assemblies are often needed to provide all spray assemblies with wash fluid.

Accordingly, a dishwasher appliance that utilizes an improved fluid distribution system would be useful. More specifically, a fluid distribution system that is capable of selectively diverting a flow of wash fluid from a fluid conduit positioned within the wash chamber would be particularly beneficial.

BRIEF DESCRIPTION OF THE INVENTION

The present subject matter provides a dishwasher appliance having a disk diverter assembly operably coupled to a primary supply conduit for selectively diverting a flow of wash fluid between a middle spray assembly and an upper spray assembly. The disk diverter assembly includes a diverter disk positioned within a diverter housing defining a fluid inlet, a first fluid outlet in fluid communication with the middle spray assembly, and a second fluid outlet in fluid communication with the upper spray assembly. The diverter disk defines an aperture and a partial flange that extends along an axial direction. A positioning assembly selectively rotates the diverter disk between a first position where wash fluid is directed only through the first fluid outlet to the middle spray assembly and a second position where wash fluid is directed only through the second fluid outlet to the upper spray assembly. Additional aspects and advantages of the invention will be set forth in part in the following description, may be apparent from the description, or may be learned through practice of the invention.

In accordance with one exemplary embodiment of the present disclosure, a dishwasher appliance defining a vertical, a lateral, and a transverse direction is provided. The dishwasher appliance includes a wash tub that defines a wash chamber for receipt of articles for washing and a pump for providing a flow of wash fluid for cleaning articles placed within the wash chamber. A primary supply conduit extends along a rear wall of the wash tub and is in fluid communication with the pump. A disk diverter assembly defines an axial direction and a radial direction. The disk diverter assembly includes a diverter housing operably coupled to the primary supply conduit, the diverter housing defining a fluid inlet, a first fluid outlet, and a second fluid outlet. A diverter disk is positioned within the diverter housing and is rotatable about the axial direction, the diverter disk defining an aperture and a partial flange that extends along the axial direction and partially around a circumference of the diverter disk. A positioning assembly is operably coupled to the diverter disk for rotating the diverter disk between i) a first position where the aperture opens the first fluid outlet and the partial flange blocks the second fluid outlet and ii) a second position where the diverter disk blocks the first fluid outlet and opens the second fluid outlet.

In accordance with another exemplary embodiment of the present disclosure, a disk diverter assembly for a dishwasher appliance is provided. The dishwasher appliance includes a wash tub that defines a wash chamber and a primary supply conduit extending along a rear wall of the wash tub. The disk diverter assembly defines an axial direction and a radial direction and includes a diverter housing operably coupled to the primary supply conduit, the diverter housing defining a fluid inlet, a first fluid outlet, and a second fluid outlet. A diverter disk is positioned within the diverter housing and is rotatable about the axial direction, the diverter disk defining an aperture and a partial flange that extends along the axial direction and partially around a circumference of the diverter disk. A positioning assembly is operably coupled to the diverter disk for rotating the diverter disk between i) a first position where the aperture opens the first fluid outlet and the partial flange blocks the second fluid outlet and ii) a second position where the diverter disk blocks the first fluid outlet and opens the second fluid outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
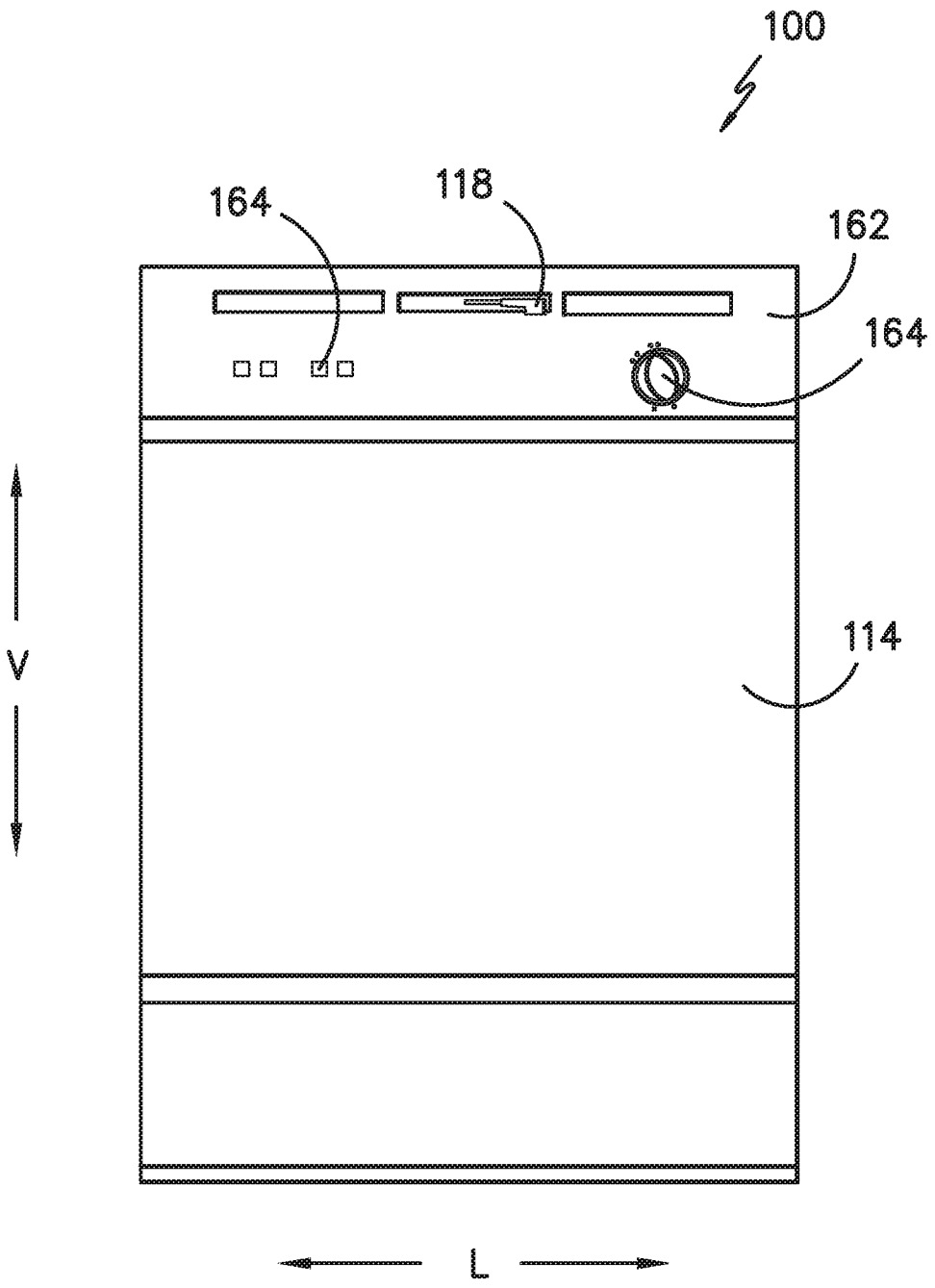
FIG. 1 provides a front view of an exemplary embodiment of a dishwashing appliance of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
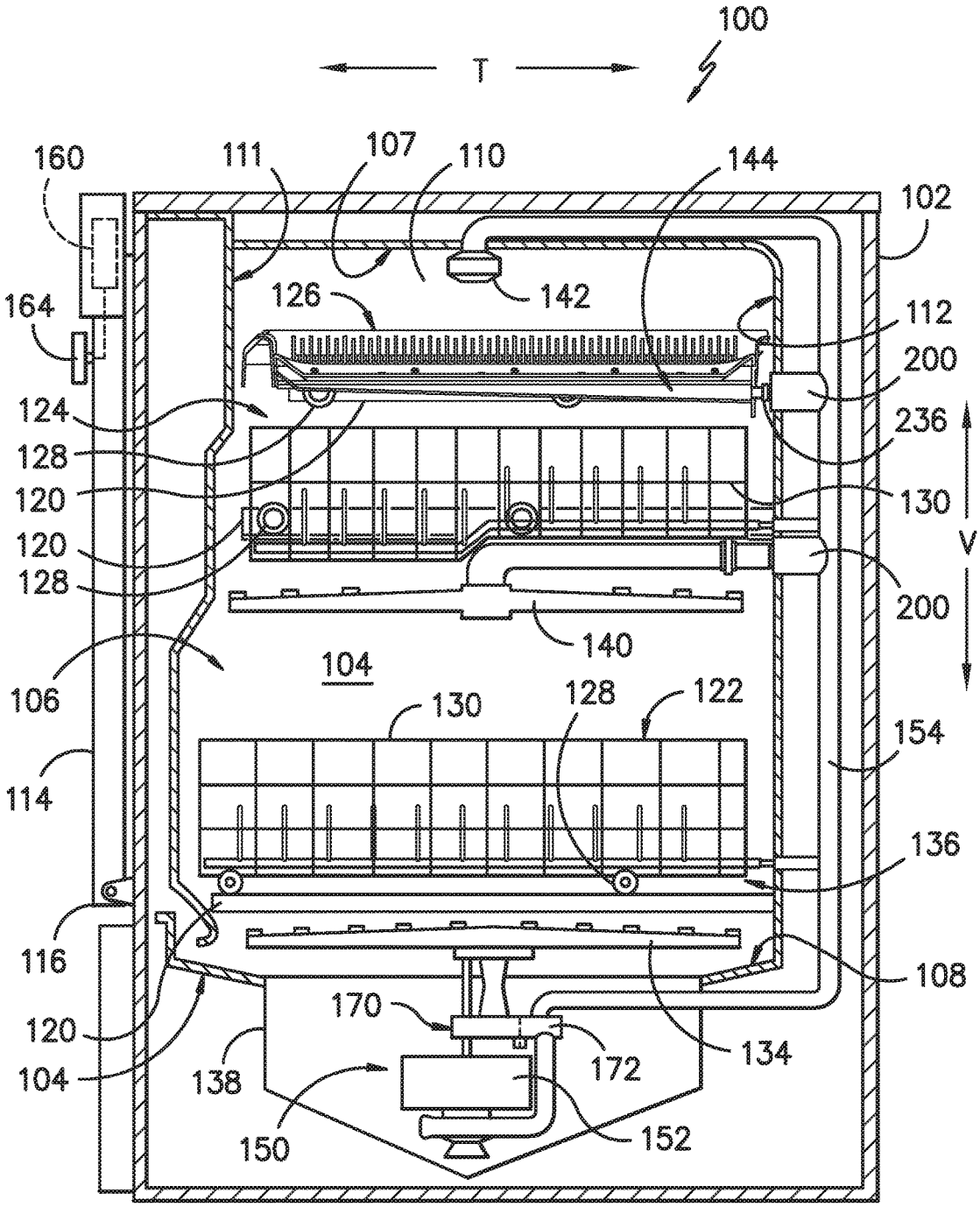
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another. The tub 104 includes a front opening (not shown) and a door 114 hinged at its bottom 116 for movement between a normally closed vertical position (shown in FIGS. 1 and 2), wherein the wash chamber 106 is sealed shut for washing operation, and a horizontal open position for loading and unloading of articles from the dishwasher 100. Latch 118 is used to lock and unlock door 114 for access to wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 114 as shown in FIGS. 1 and 2. In such an embodiment, input/output ("I/O") signals may be routed between the control system and various operational components of dishwasher 100 along wiring harnesses that may be routed through the bottom 116 of door 114. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

In operation, pump 152 draws wash fluid in from sump 138 and pumps it to a primary diverter assembly 170, e.g., which is positioned within sump 138 of dishwasher appliance. Primary diverter assembly 170 may include a diverter disk (not shown) disposed within a primary diverter chamber 172 for selectively distributing the wash fluid to the spray arm assemblies 134, 140, 142 and/or other spray manifolds or devices. For example, the diverter disk may have a plurality of apertures that are configured to align with one or more outlet ports at the top of primary diverter chamber 172. In this manner, the diverter disk may be selectively rotated to provide wash fluid to the desired spray device.

According to an exemplary embodiment, primary diverter assembly 170 is configured for selectively distributing the flow of wash fluid from pump 152 to various fluid supply conduits, only some of which are illustrated in FIG. 2 for clarity. More specifically, due to space limitations with sump 138, primary diverter assembly 170 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level and/or upper spray assemblies 140, 142, i.e., such as primary supply conduit 154.

In certain situations, it may be desirable to provide dedicated flows of wash fluid to additional spray assemblies. For example, it may be desirable to supply a flow of wash fluid only to mid-level spray arm assembly 140, only to upper spray assembly 142, or only to integral spray manifold 144. However, as explained above, space limitations within sump 138 limit the number of fluid conduits that may receive dedicated flows of wash fluid from primary diverter assembly 170. Therefore, as will be described in more detail below with respect to FIGS. 3 through 6, fluid circulation assembly 150 may further include one or more disk diverter assemblies 200 which operate as point source diverters for controlling the flow of wash fluid passing through a single fluid conduit.

More specifically, as illustrated in FIG. 2, dishwasher appliance 100 may include two disk diverter assemblies 200 positioned in series on primary supply conduit 154 to selectively divert the flow of wash fluid from pump 152. For example, the lower disk diverter assembly 200 may be used to selectively divert the flow of wash fluid either to mid-level spray arm assembly 140 or to upper spray assembly 142 and integral spray manifold 144. In addition, the upper disk diverter assembly 200 may be used to selectively divert the flow of wash fluid either to upper spray assembly 142 or integral spray manifold 144. Although illustrated as two disk diverter assemblies 200 operating in series, it should be appreciated that one or more than two disk diverter assemblies 200 may be used according to alternative embodiments to split a flow of wash fluid from any suitable conduit.

By positioning disk diverter assemblies 200 within wash chamber 106 (e.g., outside sump 138), more dedicated flows of wash fluid may be supplied by pump 152 despite the space restrictions within sump 138 and the limitations of primary diverter assembly 170. In this manner, point source wash fluid diversion may be achieved, such that wash fluid is routed directly off a fluid conduit instead of requiring a separate supply conduit. For example, as illustrated, the lower disk diverter assembly 200 is positioned adjacent mid-level spray arm assembly 140 along the vertical direction V to directly supply wash fluid to mid-level spray arm assembly 140. Similarly, the upper disk diverter assembly 200 is positioned adjacent upper spray assembly 142 along the vertical direction V to directly supply wash fluid without a separate supply conduit. In addition, primary supply conduit 154 and disk diverter assembly 200 are positioned within wash chamber 106 toward rear wall 112 of wash chamber 106 to facilitate quick and easy docking as described in more detail below.

Figure 3:
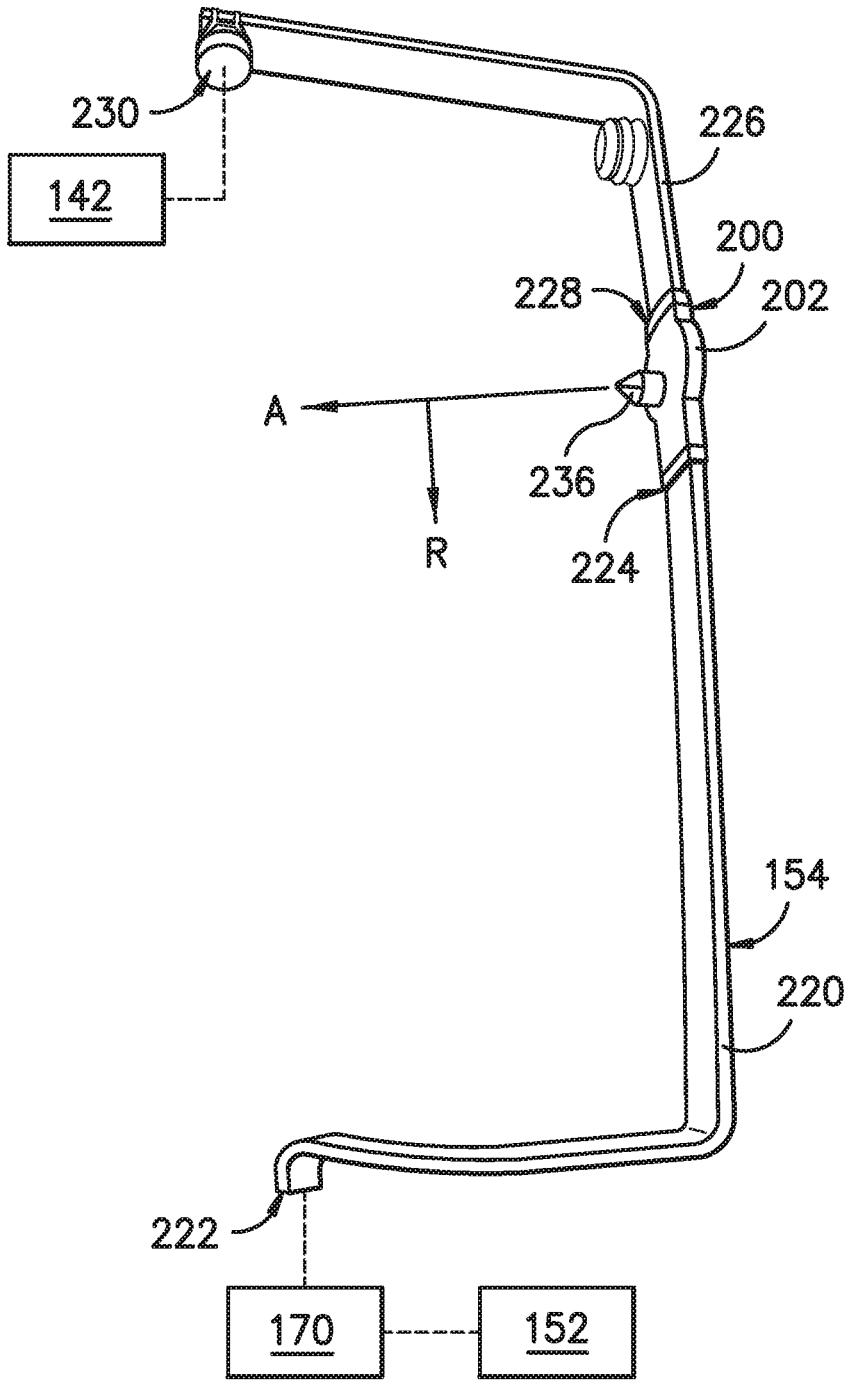
FIG. 3 provides a perspective view of a fluid distribution system including a disk diverter assembly that may be used with the exemplary dishwashing appliance of FIG. 1 according to an example embodiment of the present subject matter.
Figure 4:
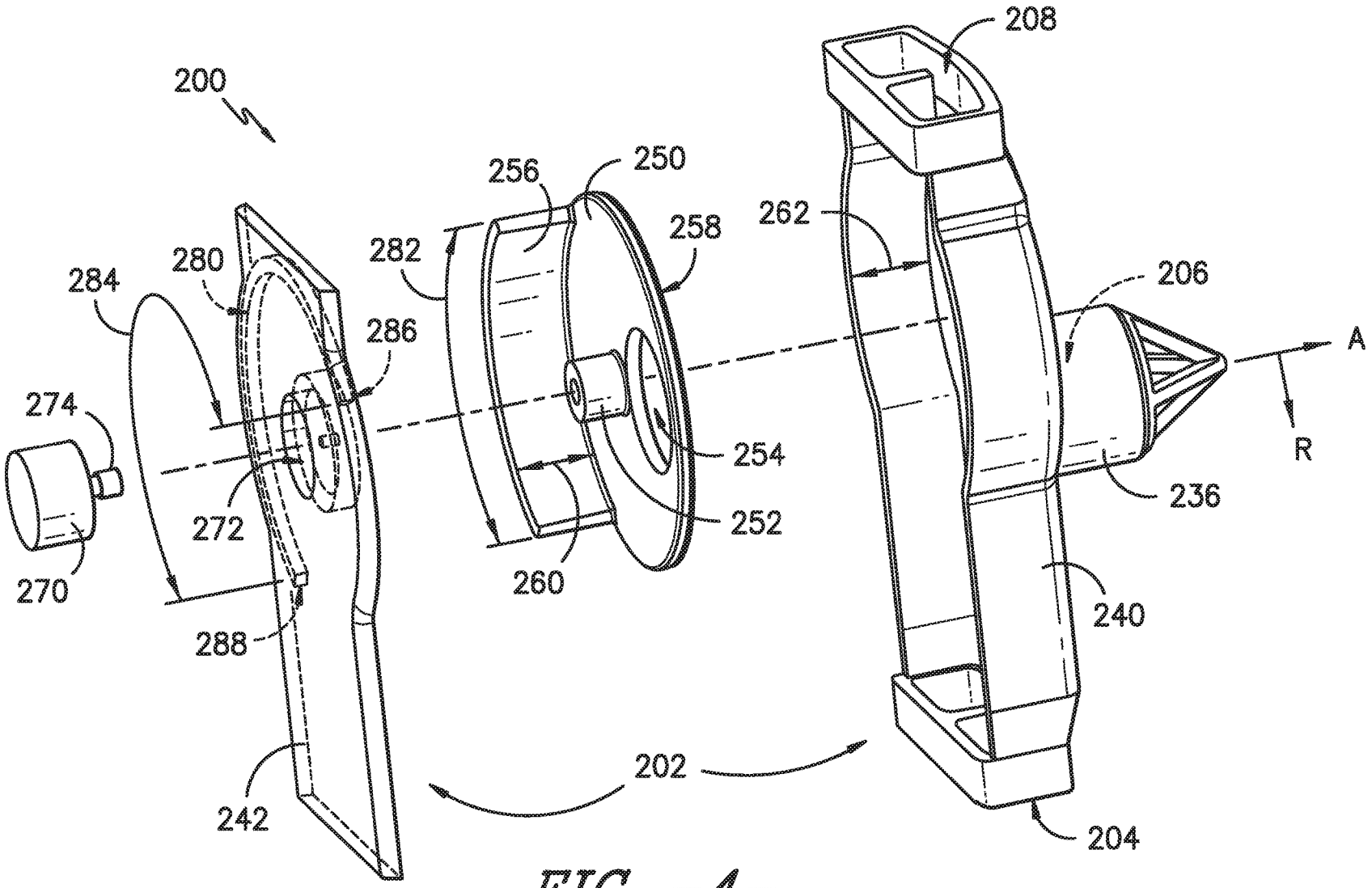
FIG. 4 provides an exploded, perspective view of the exemplary disk diverter assembly of FIG. 3 according to an example embodiment of the present subject matter.

Referring now generally to FIGS. 3 through 6, disk diverter assembly 200 will be described according to an exemplary embodiment of the present subject matter. As shown in FIGS. 3 and 4, disk diverter assembly 200 generally defines an axial direction A and a radial direction R extending perpendicular to the axial direction A. For example, when disk diverter assembly 200 is mounted to tub 104, axial direction A is substantially parallel to the transverse direction T of dishwasher appliance 100. According to the illustrated embodiment, disk diverter assembly 200 is operably coupled to or positioned within primary fluid conduit 154. However, it should be appreciated that aspects of the present subject matter may be used to selectively divert a flow of fluid in any suitable fluid supply conduit. For example, disk diverter assembly 200 may be used to divert a flow of wash fluid to any suitable spray devices or assemblies within a dishwasher appliance or from fluid conduits in any other suitable appliance.

As best illustrated in FIG. 4, disk diverter assembly 200 includes a diverter housing 202 that defines a fluid inlet 204, a first fluid outlet 206, and a second fluid outlet 208. According to the illustrated embodiment, first fluid outlet 206 is in fluid communication with a first spray assembly and second fluid outlet 208 is in fluid communication with a second spray assembly. For example, referring again to FIG. 2, first fluid outlet 206 of lower disk diverter assembly 200 is in fluid communication with mid-level spray assembly 140 and second fluid outlet 208 is in fluid communication with upper spray assembly 142 and/or integral spray manifold 144 (e.g., depending on whether there are multiple disk diverter assemblies 200).

Referring now specifically to FIG. 3, diverter housing 202 is operably coupled to, positioned within, or formed integrally with, primary supply conduit 154. In this regard, as illustrated, primary supply conduit 154 includes a lower supply conduit 220 that is fluidly coupled to diverter housing 202 to provide fluid communication between pump 152 and diverter housing 202. More specifically, lower supply conduit 220 extends from a first end 222 that is coupled to primary diverter assembly 170 and a second end 224 that is coupled to fluid inlet 204. Similarly, primary supply conduit 154 includes an upper supply conduit 226 that is fluidly coupled to diverter housing 202 to provide fluid communication between disk diverter assembly 200 and upper spray assembly 142. More specifically, upper supply conduit 226 extends from a first end 228 that is coupled to second fluid outlet 208 and a second end 230 that is coupled to upper spray assembly 142. Although disk diverter assembly 200 is illustrated herein as joining two separate pieces of primary supply conduit 154, it should be appreciated that according to alternative embodiments, diverter housing 202 may be positioned within primary supply conduit 154, may be formed integrally therewith, or may be integrated in any other suitable manner.

Referring now specifically to FIG. 4, diverter housing 202 also defines a fluid supply nozzle 236 that provides fluid communication between first fluid outlet 206 and the first spray assembly. In this manner, for example, fluid supply nozzle 236 extends along the axial direction A into wash chamber 106 such that it is configured to engage a corresponding docking port (not shown) of a spray assembly or wash manifold, such as integral spray manifold 144 (FIG. 2).

In addition, diverter housing 202 includes a main body 240 and a housing cap 242 positioned over main body 240 to define a diverter chamber 244. Disk diverter assembly 200 further includes a diverter disk 250 positioned within diverter chamber 244. Diverter disk 250 defines a central boss 252 that extends along the axial direction A such that diverter disk 250 is rotatable about the axial direction A. According to the illustrated embodiment, diverter disk 250 further defines an aperture 254 and a partial flange 256. Aperture 254 is positioned off-center from central boss 252 and is configured to open first fluid outlet 206 when diverter disk 250 is positioned at a desired angular position, while diverter disk 250 otherwise blocks first fluid outlet 206. For example, according to the illustrated embodiment, aperture 254 is positioned opposite partial flange 256 along the radial direction R.

Partial flange 256 extends along the axial direction A and partially around a circumference 258 of diverter disk 250. According to the illustrated embodiment, partial flange 256 defines an axial length 260 (measured along the axial direction A) and primary supply conduit 154 or diverter chamber 244 defines a depth 262 (also measured along the axial direction A), the axial length 260 of partial flange 256 being equal to or greater than the depth 262 of primary supply conduit 154 or diverter chamber 244. In general, partial flange 256 is configured to open second fluid outlet 208 when diverter disk 250 is positioned at a desired angular position, but otherwise blocks second fluid outlet 208.

Figure 5:
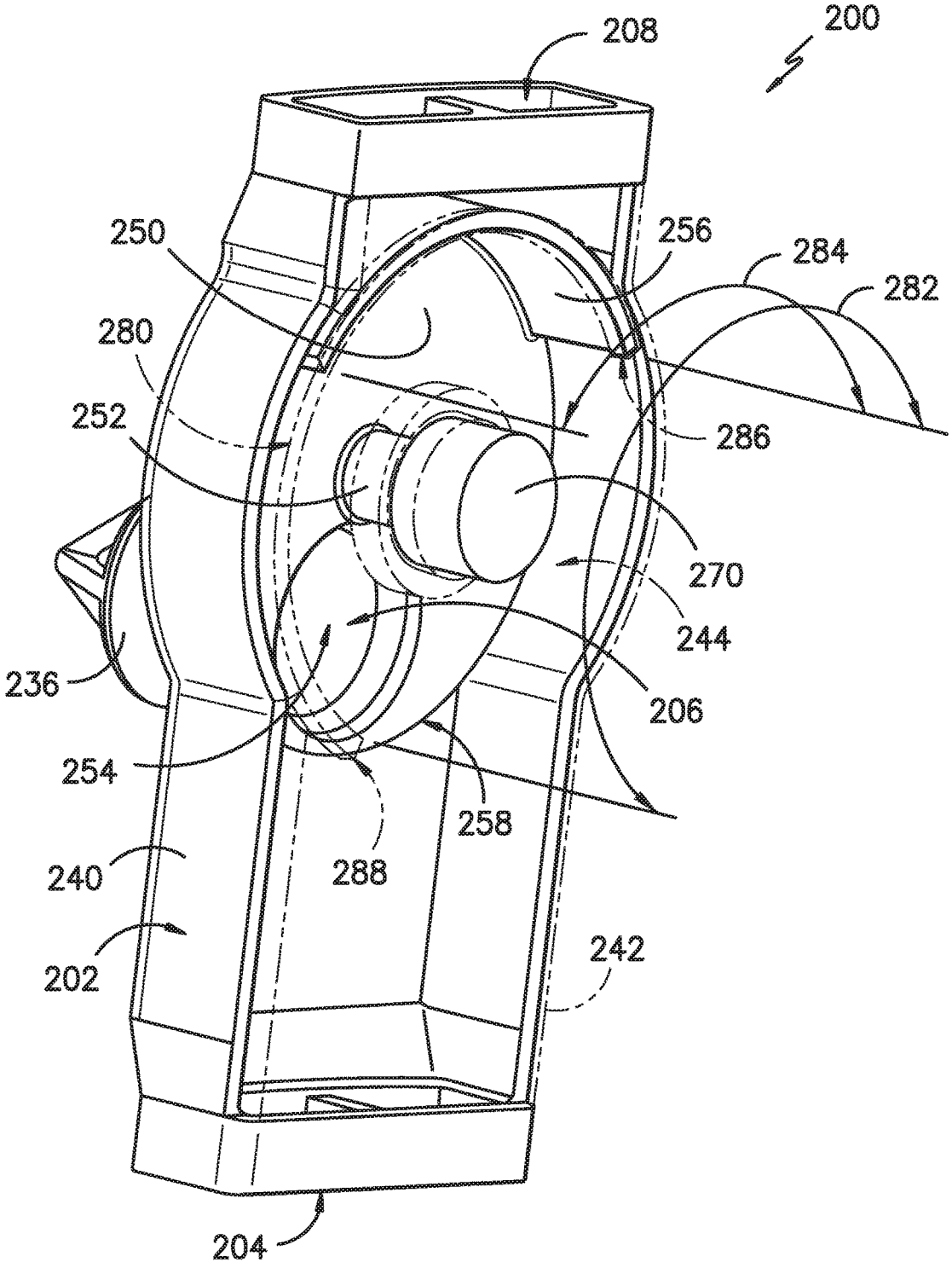
FIG. 5 provides a perspective view of the exemplary disk diverter assembly of FIG. 3, with a housing cap illustrated in phantom and a diverter disk in a first position for providing a flow of wash fluid through a first fluid outlet.
Figure 6:
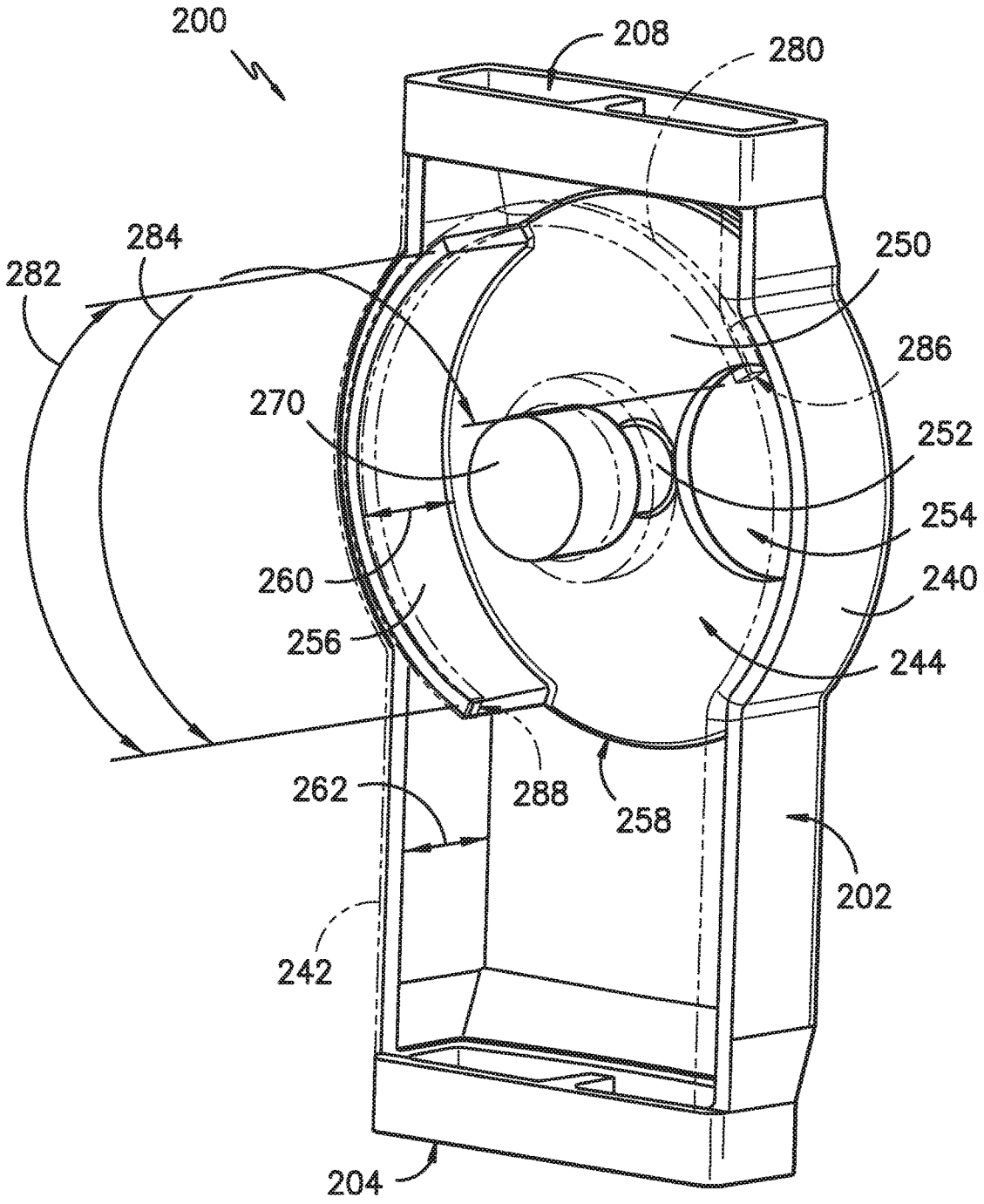
FIG. 6 provides a perspective view of the exemplary disk diverter assembly of FIG. 3, with the housing cap illustrated in phantom and the diverter disk in a second position for providing the flow of wash fluid through a second fluid outlet.

Referring now to FIGS. 5 and 6, in operation, a flow of wash fluid may be supplied to diverter chamber 244 from pump 152 through primary supply conduit 154 (or more specifically through lower supply conduit 220). If diverter disk 250 is in a first angular position (as illustrated in FIG. 5), aperture 254 is aligned with and opens first fluid outlet 206 while partial flange 256 is positioned over and blocks second fluid outlet 208 such that the flow of wash fluid is directed through first fluid outlet 206, e.g., to mid-level spray arm assembly 140. By contrast, if diverter disk 250 is in a second angular position (as illustrated in FIG. 6), aperture 254 is not aligned with first fluid outlet 206 such that diverter disk 250 blocks first fluid outlet 206. In addition, partial flange 256 is not positioned over second fluid outlet 208, such that the flow of wash fluid flows directly through second fluid outlet 208, e.g., to upper spray assembly 142.

Referring still to FIGS. 4 through 6, disk diverter assembly 200 includes a positioning assembly that is operably coupled to diverter disk 250 for rotating diverter disk 250, e.g., between the first angular position and the second angular position. More specifically, according to the illustrated embodiment, the positioning assembly is an electric motor 270. According to an exemplary embodiment, electric motor 270 may be in operative communication with a controller, such as controller 160 of dishwasher appliance 100, which may be used to operate electric motor 270 to selectively divert the flow of wash fluid through diverter chamber 244.

Electric motor 270 may be a brushless DC motor, a stepper motor, a synchronous permanent magnet motor, an AC motor, or any other suitable type of motor in any suitable configuration. In addition, although illustrated as an electric motor, another construction may use a hydraulically actuated rotation mechanism to position a diverter valve to provide the desired fluid flow between spray assemblies without the need for a motor. Indeed, positioning assembly may be any suitable device or apparatus for rotating diverter disk 250 about the axial direction A between the first angular position and the second angular position.

According to the illustrated embodiment, electric motor 270 is positioned outside diverter chamber 244 and engages diverter disk 250 via central boss 252. More specifically, housing cap 242 defines a hole 272 through which a drive shaft 274 of the electric motor 270 may extend into diverter chamber 244 where it is received by central boss 252.

Diverter disk assembly 200 may further include features for assisting the positioning assembly (e.g., electric motor 270) in moving diverter disk 250 to the desired position. For example, according to the illustrated embodiment, diverter housing 202, or more specifically housing cap 242, defines an arcuate slot 280 for slidably receiving partial flange 256 of diverter disk 250. Arcuate slot 280 is defined such that it engages partial flange 256 and acts as a positive stop configured for stopping the rotation of diverter disk 250 at one or more predetermined positions. For example, according to the illustrated exemplary embodiment, partial flange 256 defines a flange arc length 282 and arcuate slot 280 defines a slot arc length 284, the slot arc length 284 being approximately double the flange arc length 282. For example, as illustrated, flange arc length 282 spans an angle of approximately 90° and slot arc length 284 spans an angle of approximately 180°. Thus, diverter disk 250 may be rotated approximately 90° between the first angular position and the second angular position.

During operation, electric motor 270 can rotate diverter disk 250 in the clockwise direction until partial flange 256 engages a first stop 286 of arcuate slot 280. In this manner, the rotation of diverter disk 250 is arrested and diverter disk 250 is positioned in the first angular position such that first fluid outlet 206 is open. By contrast, electric motor 270 can rotate diverter disk 250 in the counter-clockwise direction until partial flange 256 engages a second stop 288 of arcuate slot 280. In this manner, the rotation of diverter disk 250 is arrested and diverter disk 250 is positioned in the second angular position such that second fluid outlet 208 is open.

According to the illustrated embodiment, diverter housing 202, including main body 240 and housing cap 242, as well as diverter disk 250 may be injection molded using a suitable plastic material. However, according to alternative embodiments, any suitable manner of forming the various components of disk diverter assembly 200 may be utilized. In addition, primary supply conduit 154 and diverter housing 202 may be integrally formed or diverter housing 202 may be separately molded and inserted into a gap in primary supply conduit 154. In addition, housing cap 242 can be injection molded using a suitable plastic material and welded onto main body 240 after diverter disk 250 is inserted to form a substantially water tight diverter chamber 244.

It should be appreciated that disk diverter assembly 200 is used only for the purpose of explaining aspects of the present subject matter. Modifications and variations may be made to disk diverter assembly 200 while remaining within the scope of the present subject matter. For example, the size, configuration, and position of diverter housing 202 may vary, the number, position, and orientation of fluid outlets 206, 208 may be changed, the geometry and operation of diverter disk 250 could be different, and other features may be adjusted while remaining within the scope of the present subject matter.

Disk diverter assembly 200 as described above provides a simple, versatile, and effective means for increasing the number of spray assemblies or manifolds that may receive a dedicated flow of wash fluid during operation of dishwasher appliance 100. In this regard, for example, dishwasher appliance 100 may include one or more disk diverter assemblies 200 positioned on any suitable fluid conduit for selectively diverting a flow of wash fluid from that fluid conduit to a spray device or manifold. Other configurations and benefits will be apparent to those of skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a wash tub that defines a wash chamber for receipt of articles for washing;

a pump for providing a flow of wash fluid for cleaning articles placed within the wash chamber;

a primary supply conduit extending along a rear wall of the wash tub and being in fluid communication with the pump; and a disk diverter assembly defining an axial direction and a radial direction, the disk diverter assembly comprising:

a diverter housing operably coupled to the primary supply conduit, the diverter housing defining a fluid inlet, a first fluid outlet, and a second fluid outlet;

a diverter disk positioned within the diverter housing and being rotatable about the axial direction, the diverter disk defining an aperture and a partial flange that extends along the axial direction and partially around a circumference of the diverter disk; and a positioning assembly operably coupled to the diverter disk for rotating the diverter disk between i) a first position where the aperture opens the first fluid outlet and the partial flange blocks the second fluid outlet and ii) a second position where the diverter disk blocks the first fluid outlet and opens the second fluid outlet.

2. The dishwasher appliance of claim 1, further comprising:

a first spray assembly, the first fluid outlet being in fluid communication with the first spray assembly; and a second spray assembly, the second fluid outlet being in fluid communication with the second spray assembly.

3. The dishwasher appliance of claim 2, wherein the diverter housing further defines a fluid supply nozzle providing fluid communication between the first fluid outlet and the first spray assembly.

4. The dishwasher appliance of claim 2, wherein the first spray assembly is a middle spray assembly and the second spray assembly is an upper spray assembly.

5. The dishwasher appliance of claim 4, wherein the disk diverter assembly is positioned adjacent the middle spray assembly along the vertical direction.

6. The dishwasher appliance of claim 1, wherein the primary supply conduit and the disk diverter assembly are positioned within the wash chamber and toward the rear wall of the wash chamber.

7. The dishwasher appliance of claim 1, wherein the partial flange defines an axial length along the axial direction and the primary supply conduit defines a depth along the axial direction, the axial length of the partial flange being equal to or greater than the depth of the primary supply conduit.

8. The dishwasher appliance of claim 1, wherein the aperture is positioned opposite the partial flange along the radial direction.

9. The dishwasher appliance of claim 1, wherein the positioning assembly comprises an electric motor.

10. The dishwasher appliance of claim 1, wherein the diverter housing defines an arcuate slot for slidably receiving the partial flange of the diverter disk, the arcuate slot configured for stopping the rotation of the diverter disk at a predetermined position.

11. The dishwasher appliance of claim 10, wherein the partial flange defines a flange arc length and the arcuate slot defines a slot arc length, the slot arc length being approximately double the flange arc length.

12. The dishwasher appliance of claim 1, further comprising a primary diverter assembly for selectively urging the flow of wash fluid through the primary supply conduit.

13. The dishwasher appliance of claim 1, wherein the diverter housing comprises:

a main body; and a housing cap positioned over the main body to define a diverter chamber, the diverter disk being positioned within the diverter chamber.

14. The dishwasher appliance of claim 13, wherein the housing cap defines a hole through which a drive shaft of the positioning assembly may extend into the diverter chamber, the diverter disk further defining a central boss for receiving the drive shaft of the positioning assembly.

15. A disk diverter assembly for a dishwasher appliance, the dishwasher appliance comprising a wash tub that defines a wash chamber and a primary supply conduit extending along a rear wall of the wash tub, the disk diverter assembly defining an axial direction and a radial direction and comprising:

a diverter housing operably coupled to the primary supply conduit, the diverter housing defining a fluid inlet, a first fluid outlet, and a second fluid outlet;

a diverter disk positioned within the diverter housing and being rotatable about the axial direction, the diverter disk defining an aperture and a partial flange that extends along the axial direction and partially around a circumference of the diverter disk; and a positioning assembly operably coupled to the diverter disk for rotating the diverter disk between i) a first position where the aperture opens the first fluid outlet and the partial flange blocks the second fluid outlet and ii) a second position where the diverter disk blocks the first fluid outlet and opens the second fluid outlet.

16. The disk diverter assembly of claim 15, the first fluid outlet is in fluid communication with a first spray assembly and the second fluid outlet is in fluid communication with a second spray assembly.

17. The disk diverter assembly of claim 16, wherein the diverter housing further defines a fluid supply nozzle providing fluid communication between the first fluid outlet and the first spray assembly.

18. The disk diverter assembly of claim 16, wherein the first spray assembly is a middle spray assembly and the second spray assembly is an upper spray assembly, and wherein the disk diverter assembly is positioned adjacent the middle spray assembly along a vertical direction.

19. The disk diverter assembly of claim 15, wherein the partial flange defines an axial length along the axial direction and the primary supply conduit defines a depth along the axial direction, the axial length of the partial flange being equal to or greater than the depth of the primary supply conduit.

20. The disk diverter assembly of claim 15, wherein the diverter housing defines an arcuate slot for slidably receiving the partial flange of the diverter disk, the arcuate slot configured for stopping the rotation of the diverter disk at a predetermined position, and wherein the partial flange defines a flange arc length and the arcuate slot defines a slot arc length, the slot arc length being approximately double the flange arc length.

* * * * *